United States Patent [19]

Ikeda et al.

[11] Patent Number: 4,833,121

[45] Date of Patent: May 23, 1989

[54] HEAT-SENSITIVE RECORDING MATERIAL

[75] Inventors: Kenji Ikeda; Akira Igarashi, both of Shizuoka, Japan

[73] Assignee: Fuji Photo Film Co., Ltd., Kanagawa, Japan

[21] Appl. No.: 117,721

[22] Filed: Nov. 6, 1987

[30] Foreign Application Priority Data

Nov. 10, 1986 [JP] Japan ..... 61-266867

[51] Int. Cl.[4] ..... B41M 5/18

[52] U.S. Cl. ..... 503/214; 427/150; 428/500; 428/511; 428/913; 503/209

[58] Field of Search ..... 427/150–152; 503/214, 225, 200, 226, 204; 428/500, 511, 913

[56] References Cited

FOREIGN PATENT DOCUMENTS 191194 11/1983 Japan ..... 503/214

99696 6/1985 Japan ..... 503/214

1162384 7/1986 Japan ..... 503/214

*Primary Examiner*—Bruce H. Hess

*Assistant Examiner*—P. R. Schwartz

*Attorney, Agent, or Firm*—Sughrue, Mion, Zinn, Macpeak & Seas

[57] ABSTRACT

A heat-sensitive recording material comprising a support having provided thereon a heat-sensitive color forming layer containing a colorless or slightly colored electron donating dye precursor and an electron accepting compound capable of forming color by the reaction with the electron donating dye precursor, wherein the heat-sensitive color forming layer contain modified polyvinyl alcohol having a hydrophobic group including a hydrocarbon residual group having 4 or more carbon atoms in the molecule.

8 Claims, No Drawings

HEAT-SENSITIVE RECORDING MATERIAL

FIELD OF THE INVENTION

The present invention relates to a heat-sensitive recording paper, and more particularly to a heat-sensitive recording material containing a colorless or slightly colored electron donating dye precursor and an electron accepting compound capable of forming color by the reaction with the electron donating dye precursor.

BACKGROUND OF THE INVENTION

A so-called two component type heat-sensitive recording material using a color forming reaction of a colorless or slightly colored electron donating dye precursor and an electron accepting compound is disclosed in Japanese Patent Publication Nos. 14039/70 and 4160/68.

The two component color forming type heat-sensitive recording material is prepared by pulverizing a colorless or slightly colored electron donating dye precursor and an electron accepting compound into fine particles and mixing a binder and the like therewith so that the two heat reactive compounds are separated by the binder and the like, and coating the mixture onto a support. Recording is conducted by heating one or both of the two heat reactive compounds to melt and contact each other, whereupon the color forming reaction occurs. Such a two component color forming type heat-sensitive recording material has great advantages in that (1) primary coloration takes place and color development is unnecessary, (2) a paper quality is nearly the same as a paper used for conventional types of recording, (3) handling of the material is easy, (4) the color forming density of the resulting colored images is high and (5) heat-sensitive recording materials having various color hues can easily be obtained. Therefore, it has a great practical value and is most widely used as a heat-sensitive recording material.

The use of the heat-sensitive recording material has recently been further developed particularly in the field of facsimile transmission, recording meters and printers. With wide spread, use of recording materials in the field of facsimile transmission, the recording speed has increased significantly. In view of this tendency to increase facsimile recording speed, a strong demand has arisen for heat-sensitive recording materials which require only a short pulse, that is, have the ability to undergo color formation with a low energy input. In other words, improvements in heat reactivity of the recording materials has long been desired. For example, it is disclosed in Japanese Patent Application (OPI) No. 47693/82 (the term "OPI" used herein refers to published unexamined Japanese patent application) that recording sensitivities can be increased by adjusting the volume average particle size of a color former to 2 μm or less. Various approaches for improvements have been made and are disclosed in Japanese Patent Application (OPI) Nos. 187393/83, 67083/84 and 54884/85. However, with the increase in a heat responsive property, fog densities on the white areas also tend to increase, thereby reducing commercial values of the recording materials. Many approaches have been made to remove the above defect, as disclosed in Japanese Patent Application (OPI) Nos. 169889/84, 205796/83 and 167297/84, wherein improvements as to fog formation on the white areas are either not completely effective, or where improvements as to fog formation are effective, there is also largely a decrease in heat responsive property.

SUMMARY OF THE INVENTION

An object of the present invention is to provide a heat-sensitive recording material capable of forming colored images having high densities requiring only a low energy input and which exhibits reduced fog in the background.

The object of the present invention can be attained by a heat-sensitive recording material comprising a support having provided thereon a heat-sensitive color forming layer containing a colorless or slightly colored electron donating dye precursor and an electron accepting compound capable of forming color by the reaction with the electron donating dye precursor, wherein the heat-sensitive color forming layer contains a modified polyvinyl alcohol having a hydrophobic group including a hydrocarbon residual group having 4 or more carbon atoms in the molecule.

DETAILED DESCRIPTION OF THE INVENTION

The modified polyvinyl alcohol having at least one hydrophobic group in the molecule thereof when used in accordance with the present invention results in a reduction of fog formation on the background of the recording material. It is preferred that the polyvinyl alcohol used in the present invention has a hydrophobic group R—X— at the terminal (wherein R is a hydrophobic group having 4 or more hydrocarbons and X is O or S).

The modified polyvinyl alcohol used in the present invention is synthesized, for example, by saponifying polyvinyl ester which is polymerized in the presence of a chain transfer agent having a hydrophobic group with 4 or more carbon atoms to form a modified polyvinyl alcohol, as disclosed in Japanese Patent Application (OPI) Nos. 71810/84 and 111639/84.

Japanese Patent Application Number 71810/84 discloses that as a method for the saponification of polyvinyl ester, conventional know methods can be applied, but the use of alcoholysis using caustic alkali, caustic potash, sodium alcoholate, and the like is particularly preferred.

Japanese Patent Application Number 111639/84 describes that in the production of a modified polyvinyl alcohol type polymer, there is no particular difficulty, and the conventional known polymerization methods and saponification methods can be applied. As the polymerization method, for example, a method comprising collectively, divisionally or continuously incorporating a monomer containing a hydrophobic group, a monomer containing a cationic group and vinyl acetate in accordance with a copolymerization reactive proportion into a polymerization system, and polymerizing the resulting mixture by using a radical polymerization initiator such as 2,2'-azobisisobutyronitrile, benzoyl peroxide and the like in the absence of a solvent, in the present of an aqueous medium or in the presence of an organic solvent such as a lower alcohol, e.g., methyl alcohol, ethyl alcohol, etc., can be applied.

The chain transfer agents have 4 or more carbon atoms include a long chain alkyl mercaptan and a long chain alkyl alcohol, of which alkyl mercaptan is the most suitable. Specific examples include octyl mercaptan, lauryl mercaptan, stearyl mercaptan, hexanol, octanol, myristyl alcohol and stearyl alcohol. They can be used alone or in combination.

The modified polyvinyl alcohol of the present invention has a degree of polymerization of preferably from 80 to 2400, more preferably from 200 to 1000. The degree of saponification of the modified polyvinyl alcohol of the present invention is preferably from 60 to 99.8%, and more preferably from 80 to 98.5%. The number of carbon atoms of a hydrocarbon residual group in the hydrophobic group is preferably from 4 to 40, more preferably from 6 to 20. A modified group selected from an anionic group, a cationic group and a nonionic group can be incorporated to make the modified polyvinyl alcohol of the present invention.

The heat-sensitive, recording material obtained in accordance with the present invention is characterized by having a water resistant surface due to the modified polyvinyl alcohol having a hydrophobic group at the terminal.

The colorless or slightly colored electron donating dye precursor used in the present invention may be triarylmethane type compounds, diphenylmethane type compounds, xanthene type compounds, thiazine type compounds and spiropyran type compounds. Specific examples are disclosed in Japanese Patent Application (OPI) No. 27253/80, the text of which is incorporated herein by reference.

Examples of triarylmethane type compounds include 3,3-bis(p-dimethylaminophenyl)-6-dimethylaminophthalide (i.e., Crystal Violet lactone), 3,3-bis(p-dimethylaminophenyl)phthalide, 3-(p-dimethylaminophenyl)-3-(1,3-dimethylindole-3-yl)phthalide and 3-(p-dimethylaminophenyl)-3-(2-methylindole-3-yl)phthalide.

Examples of diphenylmethane type compounds include 4,4-bis-dimethylaminobenzhydrin benzyl ether, N-halophenylleuco auramine and N-2,4,5-trichlorophenyl leuco auramine.

Examples of xanthene type compounds include Rhodamine-B-anilino lactam, Rhodamine (p-nitroanilino)lactam, 2(dibenzylamino)fluoran, 2-phenylamino-6-diethylaminofluoran, 2-(o-chloranilino)-6-diethylaminofluoran, 2-(3,4-dichloro-anilino)-6-diethylaminofluoran, 2-anilino-3-methyl-6piperidinofluoran and 2-phenyl-6-diethylaminofluoran.

Examples of thiazine type compounds include benzoleuco methylene blue and p-nitrobenzyl leuco methylene blue.

Examples of spiropyran type compounds include 3-methyl-spiro-dinaphthopyran, 3-ethyl-spiro-dinaphthopyran, 3,3'-dichloro-spiro-dinaphthopyran, 3-benzyl spiro-dinaphthopyran, 3-methyl-naphtho-(3-methoxybenzo)spiropyran, and 3-propyl-spiro-dibenzopyran. Electron donating dye precursors may be used alone or as a mixture of two or more.

Among these compounds, electron donating dye precursors of triaryl methane type compounds (e.g., Crystal Violet lactone) and xanthene type compounds are preferred, because fog formation is reduced and high coloring densities can be obtained. More preferred compounds are xanthene type compounds shown by the following formula (I).

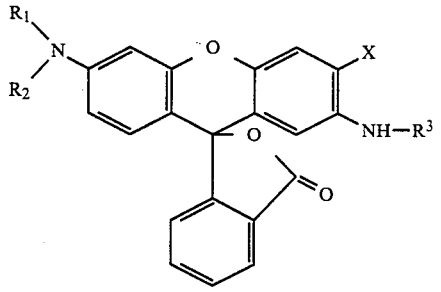

(I)

In the above formula (I), $R_1$ and $R_2$ are each preferably a substituted or unsubstituted alkyl group having from 1 to 10 carbon atoms, which may be linear, branched or $R_1$ and $R_2$ together may form a ring. Further, $R_1$ and $R_2$ may form a 5- to 7-membered heterocyclic ring containing a hetero atom.

$R_3$ is a substituted or unsubstituted aryl group, preferably an aryl group having from 6 to 20 carbon atoms. A phenyl group and a substituted phenyl group are particularly preferred. The substituent for the phenyl group is preferably an alkyl group having from 1 to 10 carbon atoms.

X is preferably an alkyl group having from 1 to 10 carbon atoms or a halogen atom.

Examples of the colorless or slightly colored electron donating dye precursors are given below, but the present invention should not be considered to be limited thereto.

Specific examples include 2-anilino-3-methyl-6-dimethylaminofluoran, 2-anilino-3-methyl-6-N-methyl-N-ethylaminofluoran, 2-anilino-3-methyl-6-N-methyl-N-(iso-propyl)aminofluoran, 2-anilino-3-methyl-6-N-methyl-N-pentylaminofluoran, 2-anilino-3-methyl-6-N-methyl-N-cyclohexylaminofluoran, 2-anilino-3-methyl-6-diethylaminofluoron, 2-anilino-3-chloro-6-dimethylaminofluoran, 2-anilino-3-methyl-6-N-ethyl-N-isoamylaminofluoran, 2-anilino-3-methyl-6-N-methyl-N-iso-amylaminofluoran, 2-anilino-3-chloro-6-diethylaminofluoran, 2-anilino-3-chloro-6-N-methyl-N-ethylaminofluoran, 2-anilino-3-chloro-6-N-methyl-N-(iso-propyl)aminofluoran, 2-anilino-3-chloro-6-N-methyl-N-pentylaminofluoran, 2-anilino-3-chloro-6-N-methyl-N-cyclohexylaminofluoran, 2-anilino-3-methyl-6-N-ethyl-N-pentylaminofluoran, 2-anilino-3-chloro-6-N-ethyl-N-pentylaminofluoran, 2-(p-methylanilino)-3-methyl-6-N-dimethylaminofluoran, 2-(p-methylanilino)-3-methyl-6-diethylaminofluoran, 2-(p-methylanilino)-3-methyl-6-N-methyl-N-ethylaminofluoran, 2-(p-methylanilino)3-methyl-6-N-methyl-N-(iso-propyl)aminofluoran, 2-(p-methylanilino)-3-methyl-6-N-methyl-N-pentylaminofluoran, 2thylanilino)-3-methyl-6-N-methyl-N-cyclohexylaminofluoran, 2-(p-methylanilino)-3-methyl-6-N-ethyl-N-pentylaminofluoran, 2-(p-methylanilino)-3-chloro-6-dimethylaminofluoran, 2-(p-methylanilino)-3-chloro-6-diethylaminofluoran, 2-(p-methylanilino)-3-chloro-6-N-methyl-N-ethylaminofluoran, 2-(p-methylanilino)-3-chloro-6-N-methyl-N-(iso-propyl)aminofluoran, 2-(p-methylanilino)-3-chloro-6-N-methyl-N-cyclohexylaminofluoran, 2-(p-methylanilino)-3-chloro-6-N-methyl-N-pentylaminofluoran, 2-(p-methylanilino)-3-chloro-6-N-ethyl-N-pentylaminofluoran, 2-anilino-3-methyl-6-N-methyl-N-furylmethylaminofluoran and 2-anilino-3-ethyl-6-N-methyl-N-furylmethylaminofluoran. These compounds may be used alone, or they may be used in a mixture of two or more compounds, for example, to adjust color tones or to improve resistance to fading of color images.

The electron accepting compounds used in the present invention may be compounds as disclosed in Japanese Patent Application (OPI) Nos. 187393/83 and 67083/84, and of those the preferred examples are compounds shown by the following formulae (II) to (VI).

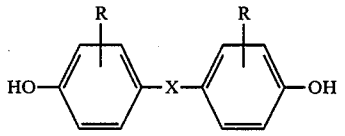

(II)

In formula (II), X is S, O, $SO_2$, $S_2$ or

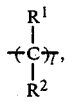

is an integer of from 0 to 3, $R_1$ and $R_2$ are each a hydrogen atom or an alkyl group having from 1 to 8 carbon atoms, or $R_1$ and $R_2$ may bond to form a cycloalkyl group. $R_1$ or $R_2$ may be an ester shown by —COOR' where R' is an alkyl group having from 1 to 10 carbon atoms. R is a linear or branched alkyl group having from 1 to 8 carbon atoms or a halogen atom

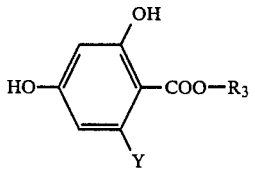

(III)

In formula (III), Y is hydrogen, $—CH_3$ or —OH, $R_3$ is

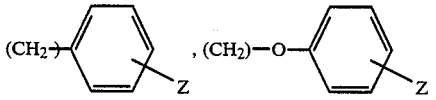

or a linear or branched alkyl group having from 1 to 6 carbon atoms, m and n are each an integer of from 0 to 3, and Z is a hydrogen atom, a halogen atom or $—CH_3$.

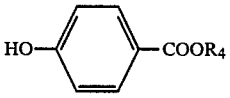

(IV)

In formula (IV), $R_4$ is a benzyl group, a halogen atom or a linear or branched alkyl group having from 1 to 8 carbon atoms.

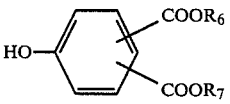

(V)

In formula (V), $R_6$ and $R_7$ are each an alkyl group having from 1 to 8 carbon atoms.

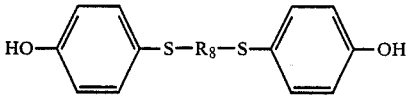

(VI)

In formula (VI), $R_8$ is an alkylene group having from 1 to 5 ether bonds.

Specific examples of the compounds shown by the above formulae (II) to (V) include 2,2-bis(4'-hydroxyphenyl)propane, 2,2-bis(4'hydroxyphenyl)pentane, 2,2-bis(4'-hydroxy-3'5'-dichlorophenyl)propane, 1,1-bis(4-'hydroxy-phenyl)cyclohexane, 2,2-bis(4'-hydroxyphenyl)hexane, 1,1-bis(4'-hydrophenyl)propane, 1,1-bis(4'-hydroxyphenyl)-butane, 1,1-bis(4'-hydroxyphenyl)pentane, 1,1-bis(4'-hydroxyphenyl)hexane, 1,1-bis(4'-hydroxyphenyl)heptane, 1,1bis(4'-hydroxyphenyl)-2-methylpentane, 1,1-bis(4'-hydroxyphenyl)-2-ethylhexane, 1,1-bis(4'-hydroxyphenyl)dodecane, 3,3-bis(4'-hydroxyphenyl)pentane, 1,2-bis(4'-hydroxyphenyl)ethane, 1,1-bis(4'-hydroxyphenyl)sulfide, 1,1-bis(4'-hydroxyphenyl)sulfone, 1,1-bis(4'-hydroxyphenyl)ether, 2,2-bis(4'-hydroxy-3',5'-dichlorophenyl)-butane, phenyl 2,4-dihydroxybenzoate, phenyl 2,4-dihydroxy-4'-methylbenzoate, phenyl 2,4-dihydroxy-4'-chlorobenzoate, phenyl 2,4-dihydroxy-6-methylbenzoate, phenyl 2,4,6-trihydroxybenzoate, phenyl 2,4-dihydroxy-6,4'-dimethylbenzoate, phenyl 2,4-dihydroxy-6-methyl-4'-chlorobenzoate, benzyl 2,4-dihydroxybenzoate, benzyl 2,4-dihydroxy-4'-methylbenzoate, benzyl 2,4-dihydroxy-4'-chlorobenzoate, benzyl 2,4-dihydroxy-6benzyl 2,4,6-trihydroxybenzoate, benzyl 2,4-dihydroxy-6,4'-dimethylbenzoate, benzyl 2,4-dihydroxy-6-methyl ethyl 4-hydroxybenzoate, propyl 4-hydroxybenzoate, isopropyl 4-hydroxybenzoate, benzyl 4-hydroxybenzoate, 2-ethylhexyl 4-hydroxybenzoate, benzyl 4-hydroxy-4'-chlorobenzoate, benzyl 4-hydroxy-4'-methylbenzoate, benzyl 4-hydroxy-4'-ethylbenzoate, dimethyl 3-hydroxy-m-phthalate, diethyl 3-hydroxy-m-phthalate, methylethyl 3-hydroxy-m-phthalate, dibutyl 3-hydroxy-m-phthalate, dimethyl 3-hydroxy-o-phthalate, diethyl 3-hydroxy-o-phthalate, methyl-bis(4-hydroxyphenyl)acetate, and iso-butyl-bis(4-hydroxyphenyl)-acetate.

Specific examples of the compounds shown by the formula (VI) are as follows.

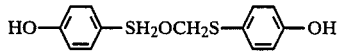

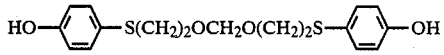

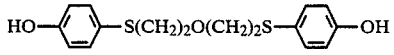

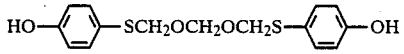

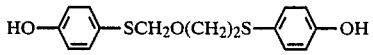

-continued

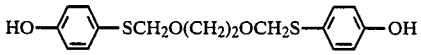

In addition to the electron accepting compounds shown by the above formulae (II) to (VI), preferred specific examples of bis-hydroxycumyl benzene or bis-hydroxy-α-methylbenzyl benzenes are 1,4-bis-p-hydroxycumyl benzene, 1,4-bis-m-hydroxycumyl benzene, 1,3-bis-p-hydroxycumyl benzene, 1,3-m-hydroxycumyl benzene, 1,4-bis-o-hydroxycumyl benzene, 1,4-bis-p-hydroxy-α-methylbenzyl benzene, and 1,3-bis-p-hydroxy-α-methylbenzyl benzene. Examples of salicylic acid derivatives are salicylic acids such as 3,5-di-α-methylbenzyl salicylic acid, 3,5-di-t-butyl salicylic acid, 3-α, α-dimethylbenzyl salicylic acid, or 4-n-pentadecyl salicylic acid or polyhydric metal salts thereof (zinc salts and aluminum salts are particularly preferred). Further, phenols such as p-phenylphenol, 3,5-diphenylphenol or cumylphenols are preferred. However, the present invention should not be limited to the above compounds.

The above electron accepting compounds (color developer) are used in an amount of preferably from 50 to 800 wt%, more preferably from 100 to 500 wt% based on the electron donating dye precursor (color former), and can be used alone or in combination.

It is preferred that the above color developers are used as a co-fusible substance with a heat-fusible substance having a low melting point or as a color developer particle having attached a heat-fusible substance on the surface thereof so that color forming reaction caused by melting the color developers at a desired temperature takes place.

Preferred specific examples of the heat-fusible substances are those compounds having a formula (VII) or (VIII).

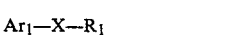

$$Ar_1—X—R_1 \quad (VII)$$

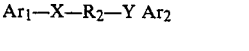

$$Ar_1—X—R_2—Y\ Ar_2 \quad (VIII)$$

In the above formulae (VII) and (VIII), $R_1$ is an aralkyl group, $R_2$ is an alkylene group having from 2 to 10 carbon atoms, $Ar_1$ and $Ar_2$ are each an aryl group, X and Y are each an oxygen atom, a sulfur atom or $CO_2$.

Preferred examples of an aryl group represented by $Ar_1$ and $Ar_2$ in the above formula include a phenyl group and a naphthyl group.

The compounds shown by the following formulae (IX) and (X) are preferred among those heat-fusible compounds shown by the formula (VII) or (VIII).

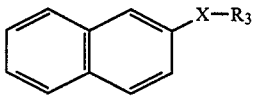

(IX)

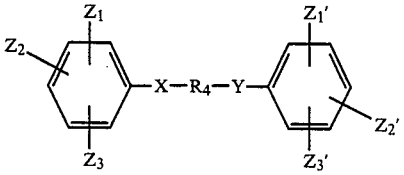

(X)

In formulae (IX) and (X), $R_3$ is a phenyl group, a benzyl group, or a lower alkyl or halogen substituted group thereof; $R_4$ is a divalent group, preferably an alkylene group, an alkylene group having a carbonyl group, an alkylene group having a halogen atom, or an alkylene group having an unsaturated bond, more preferably an alkylene group or an alkylene group having an ether bond; X and Y are each an oxygen atom, a sulfur atom or $CO_2$; and $Z_1$, $Z_2$, $Z_3$, $Z_1'$, $Z_2'$ and $Z_3'$ may be the same or different and each is a hydrogen atom, a halogen atom, an alkyloxycarbonyl group or an aralkyloxycarbonyl group.

Compounds shown by the formulae (IX) and (X) preferably have a melting point from 70° C. to 150° C., more preferably from 80° C. to 130° C. Specific examples of the compounds and their melting points are given below.

(1) β-naphthylbenzyl ether (mp. 105° C.)
(2) β-naphthylbenzyl thioether (mp. 87° C.)
(3) 1,2-bisphenoxyethane (mp. 97°–98° C.)
(4) 1,4-bisphenoxybutane (mp. 97°–98° C.)
(5) 1-phenoxy-2-(4-methylphenoxy)ethane (mp. 100°–101° C.)
(6) 1-phenoxy-2-(4-chlorophenoxy)ethane (mp. 101°–102° C.)
(7) 1-phenoxy-2-(4-isopropylphenoxy)ethane (mp. 95° C.)
(8) 1-phenoxy-2-(4-tert-butylphenoxy)ethane (mp. 92°–93° C.)
(9) 1-phenoxy-2-(3,4-dimethylphenoxy)ethane (mp. 100°–101° C.)
(10) 1,3-bis(4-methoxyphenoxy)propane (mp. 89°–90° C.)
(11) 1-(4-methylphenoxy)-2-(2-methylphenoxy)ethane (mp. 85°–86° C.)
(12) 1-(4-methylphenoxy)-2-(3-methylphenoxy)ethane (mp. 91°–92° C.)
(13) 1,6-bisphenoxyhexane (mp. 80° C.)
(14) 1-phenoxy-2-(4-methoxyphenoxy)ethane (mp. 102°–104° C.)
(15) 1-phenoxy-2-(3-methoxyphenoxy)ethane (mp. 82°–83° C.)
(16) 1-phenoxy-2-(4-fluorophenoxy)ethane (mp. 90°–93° C.)
(17) 1-phenoxy-2-(4-ethylphenoxy)ethane (mp. 106° C.)
(18) 1,2-bis(2-methylphenoxy)ethane (mp. 82°–83° C.)
(19) 1,3-bis(ethylphenoxy)propane (mp. 80° C.)
(20) 1-phenoxy-2-(4-n-propylphenoxy)ethane (mp. 90°–91° C.)
(21) 1-phenoxy-4-(4-ethylphenoxy)butane (mp. 80°–81° C.)
(22) 1,2-bis(3-methylphenoxy)ethane (mp. 98° C.)
(23) 1-(4-methoxyphenoxy)-2-(2-methylphenoxy)ethane (mp. 82°–83° C.)
(24) 1-(4-ethoxyphenoxy)-2-(2-chlorophenoxy)ethane (mp. 91°–93° C.)
(25) 1-(4-methylphenylthio)-2-(4-ethoxyphenoxy)ethane (mp. 89°–91° C.)
(26) 1-(4-methoxyphenylthio)-2-(4-ethoxyphenoxy)ethane (mp. 87°–88° C.)
(27) 1,2-bis(4-methylphenylthio)ethane (mp. 80° C.)
(28) 1,2-bis(4-methoxyphenylthio)ethane (mp. 108°–110° C.)
(29) 1,4-bis(4-methoxyphenylthio)butane (mp. 102°–103° C.)
(30) 1,2-bis(4-ethoxyphenylthio)ethane (mp. 90°–91° C.)
(31) 1,2-bis(4-bromophenylthio)ethane (mp. 113°–114° C.)
(32) 1,4-bis(4-bromophenylthio)butane (mp. 98°–99° C.)

(33) 1,2-bis(4-butoxyphenylthio)ethane (mp. 102°-103° C.)
(34) 1,2-bis(4-chlorophenylthio)ethane (mp. 92°-93° C.)
(35) 1,2-bis(4-n-propyloxyphenylthio)ethane (mp. 111°-112° C.)
(36) 1,2-bis(4-iso-propyloxyphenylthio)ethane (mp. 115°-116° C.)
(37) 1,2-bis(4-tert-butylphenylthio)ethane (mp. 107°-108° C.)
(38) 1-(4-methoxyphenoxy)-2-phenylthioethane (mp. 82°-83° C.)

The above heat-fusible compounds can be used either individually or in combination, and are preferably used in an amount of from 10 to 200 wt%, more preferably from 20 to 150 wt% based on the electron accepting compounds to obtain a sufficient heat-response sensitivity.

The preferred coating amount of color former, color developer or heat-fusible substance is about 0.3 to 3.0 g/m$^2$.

A water-soluble binder is added into a recording layer of a heat-sensitive recording material of the present invention. Suitable binders include compounds having a solubility of at least 5 wt % in water at 25° C. Specific examples of the binder include polyvinyl alcohol, methyl cellulose, carboxymethyl cellulose, hydroxyethyl cellulose, starches (including modified starches), gelatin, gum arabic, casein, a hydrolysis product of a copolymer of styrene and maleic anhydide, a hydrolysis product of a copolymer of ethylene and maleic anhydride, a hydrolysis product of a copolymer of isobutylene and maleic anhydride, carboxymodified polyvinyl alcohol, polyacrylamide, and a saponified product of a copolymer of vinyl acetate and polyacrylic acid.

These binders may be used alone as binders for finely dispersing the electron donating dye precursor, the electron accepting compounds, the heat-fusible compounds and the modified polyvinyl alcohol compounds of the present invention.

If desired, pigments, water-insoluble binders, metal soaps, waxes and surface active agents can be added to the recording layer of the heat-sensitive recording material of the present invention.

Suitable pigments include zinc oxide, calcium carbonate, barium sulfate, titanium oxide, lithopone, talc, agalmatolite, kaolin, aluminum hydroxide, silica, and amorphous silica, etc., and precipitated calcium carbonate, kaolin, surface-treated amorphous silica and aluminum hydroxide are preferred.

Suitable water-insoluble binders include generally synthetic rubber latices or synthetic resin emulsions, such as a styrene-butadiene rubber latex, an acrylonitrilebutadiene rubber latex, a methyl acrylate-butadiene rubber latex and a vinyl acetate emulsion, etc. The amount of surface active agents to be added in the rubber latex or emulsion should be as small as possible to prevent fog formation in the heat-sensitive recording material and a so-called soap free rubber latex or emulsion is preferred.

Suitable metal soaps are metal salts of higher fatty acids. Emulsions of zinc stearate, calcium stearate and aluminum stearate and the like may be used.

Suitable waxes may be emulsions of paraffin wax, microcrystalline wax, carnauba wax, methylolstearamide, polyethylene wax and polystyrene wax.

Suitable surface active agents used in this invention include alkali metal salts of sulfosuccinic acid compounds and fluorine containing surface active agents.

For the purpose of ensuring fastness of recorded color images, it is preferred to incorporate a discoloration inhibitor that prevents color image fading into the heat-sensitive recording layer.

Suitable discoloration inhibitors include phenol derivatives, and particularly hindered phenol compounds.

A coating solution comprised of the above is made up and coated on a support such as a neutral paper, a high quality paper or a plastic film and dried. To prepare a coating solution, all components are first mixed and then pulverized, or some components in combination may be pulverized and dispersed and then mixed together with other components.

The present invention is illustrated in more detail by the following Examples, but should not be considered to be limited thereto.

EXAMPLE 1

10 g of 2-anilino-3-methyl-6-N-methyl-N-cyclohexylaminofluoran, 10 g of 2-anilino-3-chloro-6-diethylaminofluoran as an electron donating dye precursor and 100 g of 5% aqueous solution of modified polyvinyl alcohol having a hydrophobic group at the terminal (number of carbon atoms: 72; degree of polymerization: 300; hereinafter referred to as "modified polyvinyl alcohol" ) of the present invention are pulverized in a ball mill for one day and one night to obtain a dispersion having a volume average particle diameter of 3 $\mu$ or less. 20 g of 2,2-bis(p-hydroxyphenyl)propane as an electron accepting compound and 100 g of a 5% aqueous solution of a modified polyvinyl alcohol were dispersed in a ball mill for one day and one night to obtain a dispersion having volume average particle diameter of 3 $\mu$ or less. 20 g of $\beta$-naphthylbenzyl ether as a heat-fusible compound and 100 g of a 5% aqueous solution of modified polyvinyl alcohol were dispersed in a ball mill for one day and one night to obtain a dispersion having a volume average particle diameter of 3 $\mu$ or less. 20 g of 1,1,3-tris(2-methyl-4-hydroxy-5-tert-butylphenyl)butane as a discoloration inhibitor and 100 g of a 5% aqueous solution of modified polyvinyl alcohol were pulverized in a ball mill for one day and one night to obtain a dispersion having a volume average particle diameter of 3 $\mu$ or less. 80 g of calcium carbonate (manufactured by Shiraishi Kogyo Co., Ltd. and available under the trade name "Unibar" ) was dispersed with 160 g of 0.5% sodium hexametaphosphate solution in a homogenizer and used as a pigment. Each of the thus obtained solutions was mixed in a mixing ratio of 5 g of the dispersion of an electron donating dye precursor, 10 g of the dispersion of an electron accepting compound, 5 g of the dispersion of the heat-fusible compound, 2 g of the dispersion of the discoloration inhibitor and 22 g of the dispersion of the pigment, and then 3 g of an emulsion of 21% zinc stearate was added thereto to obtain a coating solution.

The resulting coating solution was coated on a high quality paper having a weight capacity of 50 g/m$^2$ by a wire bar so that the dry amount was 7 g/m$^2$ and dried by an oven at 50° C. for 2 minutes to obtain a heat-sensitive recording material.

EXAMPLE 2

The same procedure as in Example 1 was repeated to prepare a heat-sensitive recording material except that 1-phenoxy-4-(4-ethylphenoxy)butane was used as a heat-fusible compound.

EXAMPLE 3

The same procedure as in Example 1 was repeated to prepare a heat-sensitive recording material except that 2-anilino-3-methyl-6-N-iso-amyl-N-ethylaminofluoran was used, as one of electron donating dye precursors of Example 1, instead of 2-anilino-3-methyl-6-N-methyl-N-cyclohexylaminofluoran, and 1,2-bis(4-methoxyphenylthio)ethane was used as a heat-fusible compound.

COMPARATIVE EXAMPLES 1 AND 2

The same procedures as in Examples 1 and 3 were repeated to prepare a heat-sensitive recording material except that a polyvinyl alcohol ("Kurare PVA 105", a trade name, degree of saponification: 98%, degree of polymerization: 500) was used instead of modified polyvinyl alcohol, and stearic acid amide was used as a heat-fusible compound.

COMPARATIVE EXAMPLE 3

The same procedure as in Example 1 was repeated to prepare a heat-sensitive recording material except that polyvinyl alcohol as in Comparative Examples 1 and 2 was used instead of modified polyvinyl alcohol.

Samples of heat-sensitive recording materials prepared in Examples and Comparative Examples were tested to evaluate their efficiencies.

A test chart No. 3 of The Electric Image Society was copied using a high speed facsimile UF-920 manufactured by Matsushita Denso Co., Ltd. and the density of the copied image was measured using a RD-918 type densitometer manufactured by Macbeth Co., Ltd. to evaluate a heat-response sensitivity.

Heat-sensitive recording materials having no image formed thereon and heat-sensitive recording materials having colored images formed in accordance with the above method were stored for 24 hours to evaluate the storage stability of heat-sensitive recording materials at a high temperature and at a high humidity, specifically under the conditions at 60° C. and 30% RH to evaluate heat resistance and at 40° C. and 90% RH to evaluate moisture resistance. Then, fog densities on white areas and densities of colored areas before and after the storage and the densities of colored images formed after the storage were measured respectively by a RD-918 type densitometer manufactured by Macbeth Co., Ltd.

The storage stability of densities of colored areas is shown by the following formula.

$$\frac{\text{Density after storage}}{\text{Density immediately after color forming}} \times 100(\%)$$

The results are shown in Table 1. It is clear from the results that both fog formation at the background and a heat response sensitivity are excellent in the present invention.

TABLE 1

| Run No. | Printed Density | Fog at Background | Residual Ratio After Heat Resistance Test | Fog | Residual Ratio after Moisture Resistance Test | Fog |
|---|---|---|---|---|---|---|
| Example 1 | 1.14 | 0.06 | 98.5 | 0.07 | 100.1 | 0.06 |
| Example 2 | 1.18 | 0.06 | 97.8 | 0.07 | 99.6 | 0.06 |
| Example 3 | 1.26 | 0.07 | 98.0 | 0.08 | 98.4 | 0.07 |
| Comparative Example 1 | 0.90 | 0.08 | 90.3 | 0.10 | 93.5 | 0.10 |
| Comparative Example 2 | 0.93 | 0.09 | 88.0 | 0.11 | 91.5 | 0.11 |
| Comparative Example 3 | 1.15 | 0.12 | 97.5 | 0.18 | 98.5 | 0.15 |

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having provided thereon a heat-sensitive color forming layer containing a colorless or slightly colored electron donating dye precursor and an electron accepting compound capable of forming color by the reaction with said electron donating dye precursor, wherein said heat-sensitive color forming layer contains a modified polyvinyl alcohol having a hydrophobic group including a hydrocarbon residual group having 4 or more carbon atoms in the molecule, wherein the modified polyvinyl alcohol is produced by saponifying a polyvinyl ester in the presence of a chain transfer agent having a hydrophobic group with 4 or more carbon atoms, and wherein the chain transfer agent having a hydrophobic group is selected from the group consisting of a long chain alkyl mercaptan and a long chain alkyl alcohol.

2. A heat-sensitive recording material as in claim 1, wherein the long chain alkyl mercaptan is an octyl mercaptan, a lauryl mercaptan or a stearyl mercaptan.

3. A heat-sensitive recording material as in claim 1, wherein the long chain alkyl alcohol is hexanol, octanol, myristyl alcohol, or stearyl alcohol.

4. A heat-sensitive recording material as in claim 1, wherein the hydrocarbon residual group in the hydrophobic group has from 4 to 40 carbon atoms.

5. A heat-sensitive recording material as in claim 4, wherein the hydrocarbon residual group in the hydrophobic group has from 6 to 20 carbon atoms.

6. A heat-sensitive recording material as in claim 1, wherein the modified polyvinyl alcohol has a degree of polymerization of from 80 to 2,400 and a degree of saponification of from 60 to 99.8%.

7. A heat-sensitive recording material as in claim 6, wherein the modified polyvinyl alcohol has a degree of polymerization of from 200 to 1,000 and a degree of saponification of from 80 to 98.5%.

8. A heat-sensitive recording material as in claim 1, wherein the hydrophobic group is represented by R—X— wherein R is a hydrophobic group having 4 to 40 carbon atoms and X is O or S.

* * * * *